US005419533A

United States Patent [19]

Barta et al.

[11] Patent Number: 5,419,533

[45] Date of Patent: May 30, 1995

[54] LIFTING DEVICE

[75] Inventors: Allen Barta, Blys; Vic Stark, Billings, both of Mont.

[73] Assignee: BFJ Company, Billing, Mont.

[21] Appl. No.: 95,711

[22] Filed: Jul. 20, 1993

[51] Int. Cl.[6] ..... B66F 3/24

[52] U.S. Cl. ..... 254/2 B; 254/93 H

[58] Field of Search ..... 254/93 H, 93 R, 2 R, 254/2 B, 2 C; 92/108, 17, 18, 107, 117 R, 23; 60/477; 188/151 A, 67; 187/8.47, 8.49

[56] References Cited

U.S. PATENT DOCUMENTS

| | | | |
|---|---|---|---|
| 2,664,073 | 12/1953 | Pine | 254/93 H |
| 3,047,269 | 7/1962 | Renshaw | 254/93 H |
| 5,000,424 | 3/1991 | Inoue | 254/93 H |

*Primary Examiner*—Robert C. Watson
*Attorney, Agent, or Firm*—Jerry D. Guenther

[57] ABSTRACT

A lifting device for lifting heavier loads is disclosed including a square base plate having a plurality of wheels attached in triangular arrangement which provide a low center of gravity for the lifting device. Mounted in the center of the square base plate is a cylindrical housing having a sealed tube within an unsealed tube, a space between the tubes, a fluid holding chamber, a fluid filed chamber, a fluid filled space, a plurality of hydraulic seals, an orifice between the fluid filled space and the fluid holding chamber, a plurality of orifices in the bottom aspect of the fluid holding chamber and a plurality of external connections, an orifice in the top aspect of the fluid holding chamber between the fluid holding chamber and the operating chamber, a tube in the fluid holding chamber for transferring pressurized hydraulic fluid to the operating chamber, and a piston assembly having an operating chamber which is slidable longitudinally in the cylindrical housing. A reservoir chamber for hydraulic fluid is provided. A plurality of gussets attach to the support base, secure the cylindrical housing, and attach to a support collar. A support tube is attached to the support base and surrounds the lower portion of the cylindrical housing. Means are provided for activating the piston assembly. A locking mechanism which circumscribes, engages and secures the piston assembly is provided as well as means of engaging and disengaging the locking mechanism. A control means for operating the lifting device is included.

9 Claims, 4 Drawing Sheets

LIFTING DEVICE

BACKGROUND OF THE INVENTION

1. Field of the Invention

This invention pertains generally to improvements relating to fluid operated lifting devices for lifting heavier weights, and more particularly concerns a locking mechanism in such lifting devices.

2. Description of the Prior Art

Fluid operated lifting devices are known sometimes to collapse under load and such a collapse may be attended with serious consequences. Lifting heavier weights amplifies the consequences. Obviously, it is desirable that a lifting device for heavier loads be simple, strong and safe. A lifting device for heavier loads should be portable. A lifting device for heavier loads should provide a locking mechanism to prevent collapse under load. And, a lifting device for heavier loads should provide for remote control means.

Lifting devices and hydraulic lifting devices are known. Means for preventing inadvertent lowering or collapse of a lifting device under load are known. Generally, prior art discloses lifting devices and hydraulic lifting devices having locking mechanisms requiring mechanical, manual release from a position of close proximity to the lifting device. In summary of the known prior art, hydraulic lifting devices with locking mechanisms have been utilized, but little attention has been given to provide for safe remote disengagement of the locking mechanism when the lifting device is being lowered under load.

Therefore, it is a feature of the present invention to provide an improved lifting device for heavier loads which is simple, strong and safe to operate.

It is another feature of the present invention to provide an improved lifting device for heavier loads which has a unique locking mechanism for the prevention of inadvertent collapse under load.

It is another feature of the present invention to provide an improved lifting device for heavier loads which is portable.

It is another feature of the present invention to provide an improved lifting device for heavier loads which can be operated by remote control for operator safety.

SUMMARY OF THE INVENTION

The lifting device in accordance with the present invention includes a square base plate having a plurality of wheels attached in triangular arrangement which provide a low center of gravity for the lifting device. Mounted in the center of the square base plate is a cylindrical housing having a sealed tube within an unsealed tube and a space between the tubes. Also provided are a fluid holding chamber, a fluid filed chamber, a fluid filled space, a plurality of hydraulic seals, an orifice between the fluid filled space and the fluid holding chamber, a plurality of orifices in the bottom aspect of the fluid holding chamber and a plurality of external connections, an orifice in the top aspect of the fluid holding chamber between the fluid holding chamber and the operating chamber, a tube in the fluid holding chamber for transferring pressurized hydraulic fluid to a piston assembly having an operation chamber. A reservoir chamber for hydraulic fluid is provided. A plurality of gussets attach to the support base, secure the cylindrical housing, and attach to a support collar. A support tube is attached to the support base and surrounds the lower portion of the cylindrical housing. Means are provided for activating the piston assembly. The piston assembly is slidable longitudinally in the cylindrical housing. A locking mechanism which circumscribes, engages and secures the piston assembly is provided as well as means of engaging and disengaging the locking mechanism. A control means for operating the lifting device is included.

IN THE DRAWINGS

DESCRIPTION OF THE PREFERRED EMBODIMENT

Figure 1:
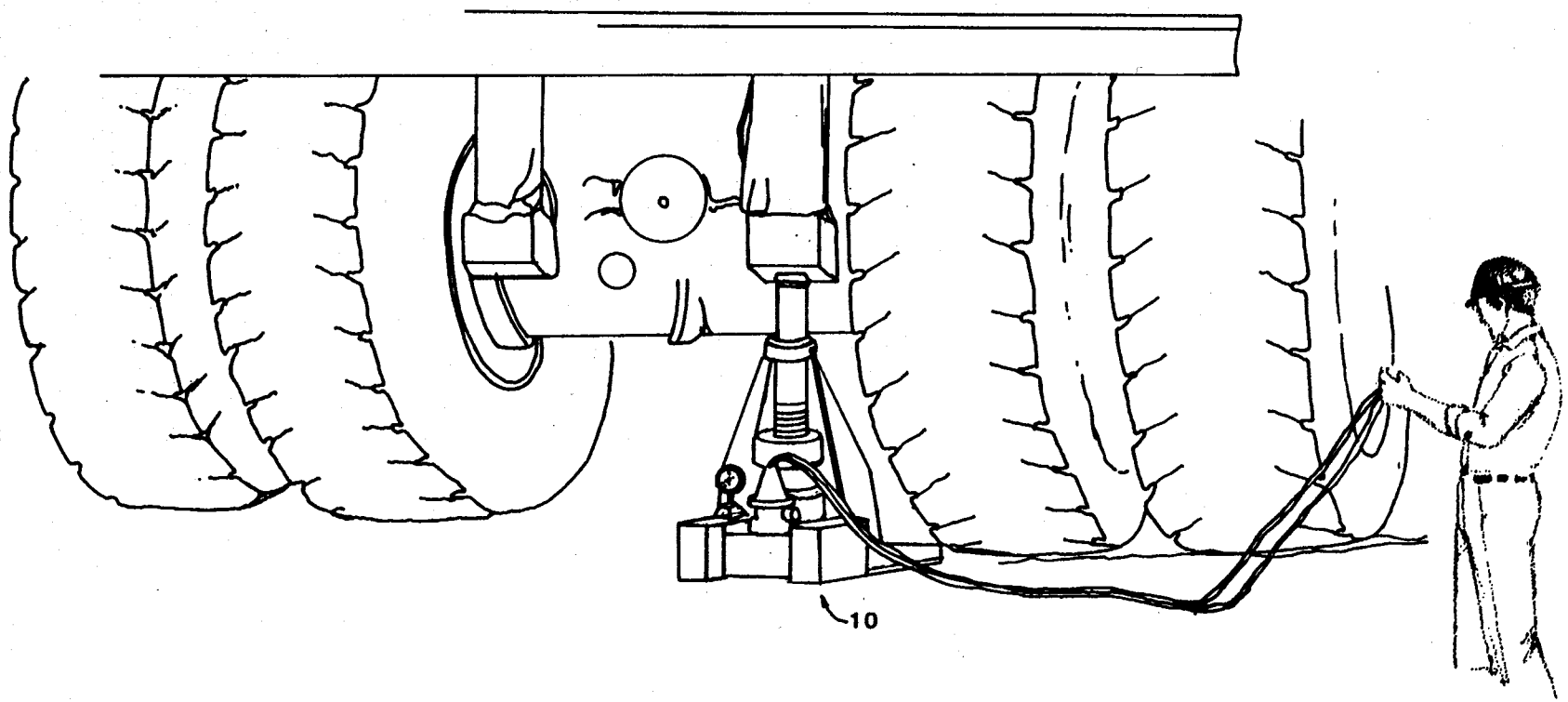
FIG. 1 is a perspective view of a preferred embodiment of a lifting device in accordance with the present invention employed in lifting a heavy load controlled by remote means.

Referring now more particularly to the drawings, reference numerals will be used to denote like parts or structural features in the different views. Referring first to FIG. 1, a lifting device 10 in accordance with the present invention is shown in service supporting a heavy load. Such a use is illustrated as a typical use, although it will be seen that lifting device 10 is a versatile apparatus having many applications.

Figure 2:
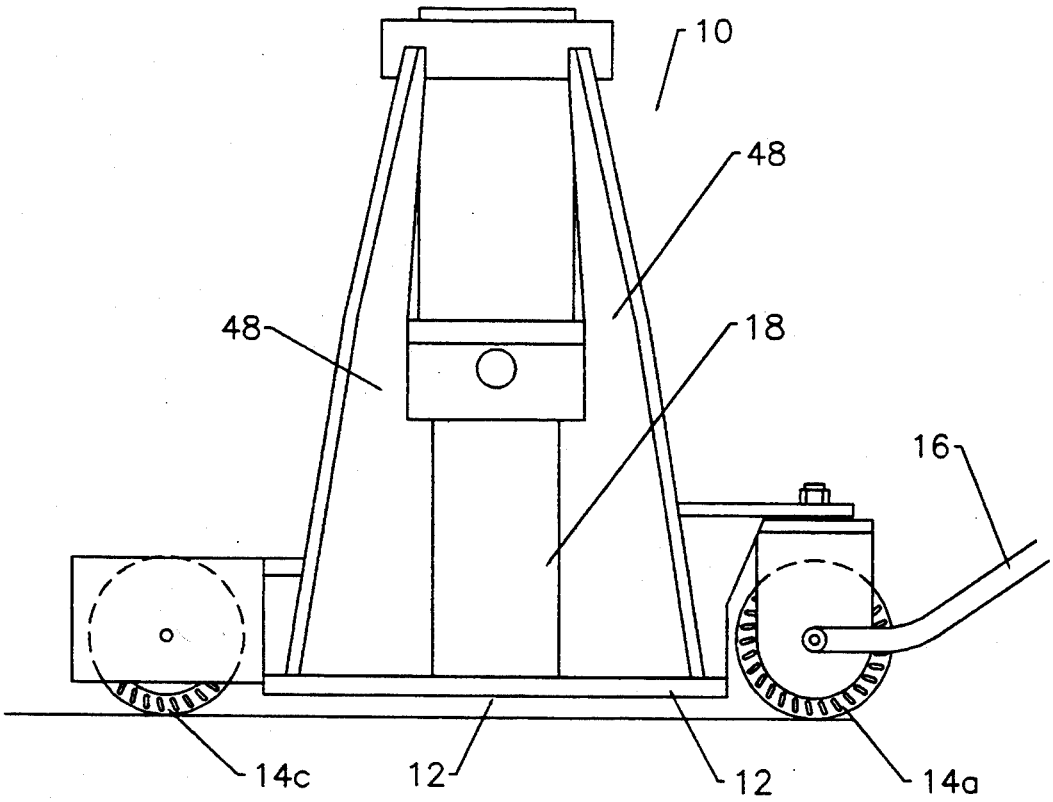
FIG. 2 is side view of a preferred embodiment of a lifting device in accordance with the present invention.
Figure 3:
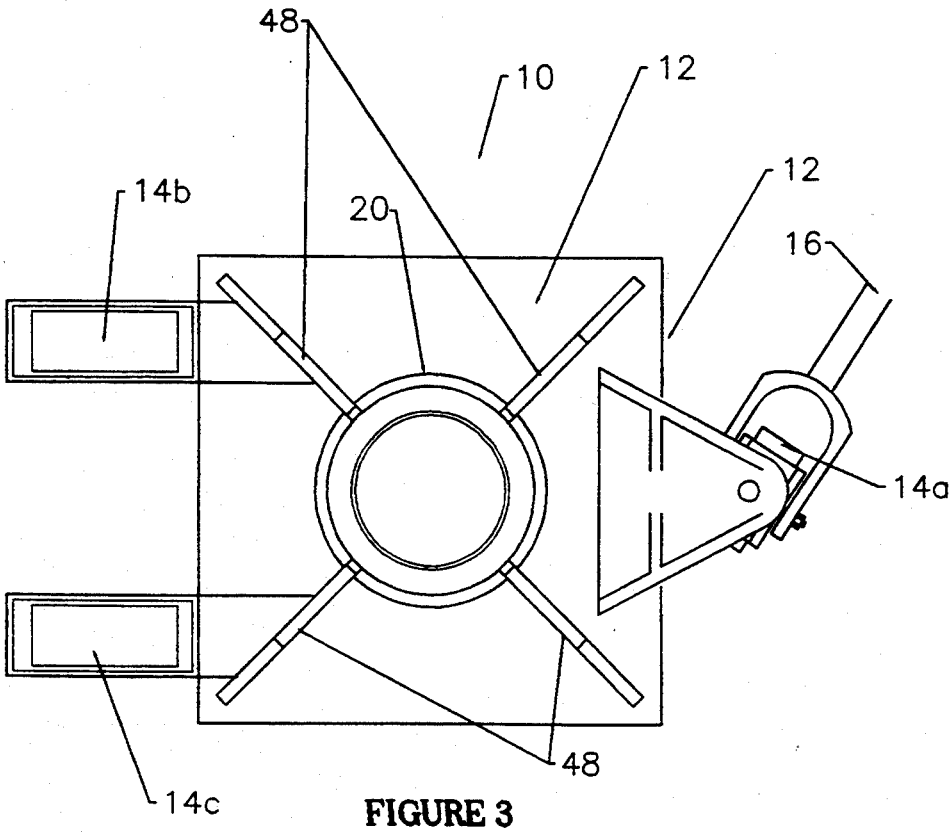
FIG. 3 is a top view of a preferred embodiment of a lifting device in accordance with the present invention.

Referring to FIGS. 2 and 3, the lifting device 10 is more or less conventional in construction. The lifting device 10 includes a square base plate 12. The square base plate 12 has an upper plane surface, a lower plane surface, and four edges when positioned generally horizontal with the surface upon which the lifting device 10 is supported in normal operation. A plurality of wheels **14*a*,14*b*,14*c* attach to two edges of the square base plate 12 in triangular arrangement whereby two of the wheels 14*b*,14*c* are rigidly attached in spaced relation perpendicular to an edge of the square base plate 12 and a third steerable wheel 14*a* is attached in movable manner to the center of the edge of the square base plate 12 opposite the edge of the square base plate 12 where the two wheels 14*b*,14*c* are rigidly attached. The plurality of wheels 14*a*,14*b*,14*c* are attached to the square base plate 12 in such a manner as to provide for a low center of gravity for the lifting device 10. A handle 16 is attached to the third steerable wheel 14*a* and provides for directional movement and physical portability of the lifting device 10**.

Figure 4:
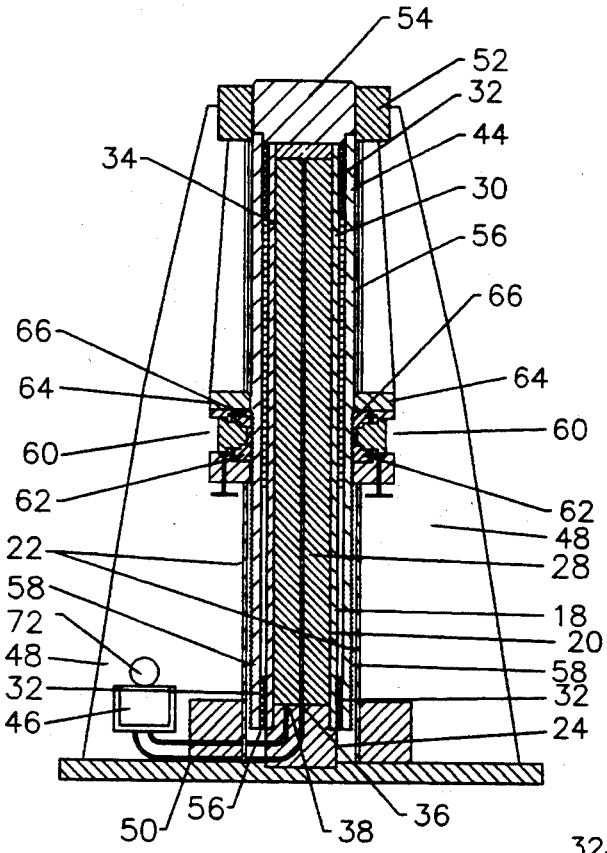
FIG. 4 is a cross-sectioned side view of a preferred embodiment of a lifting device in accordance with the present invention showing the cylindrical housing, piston assembly, lift cylinder and locking mechanism.
Figure 5:
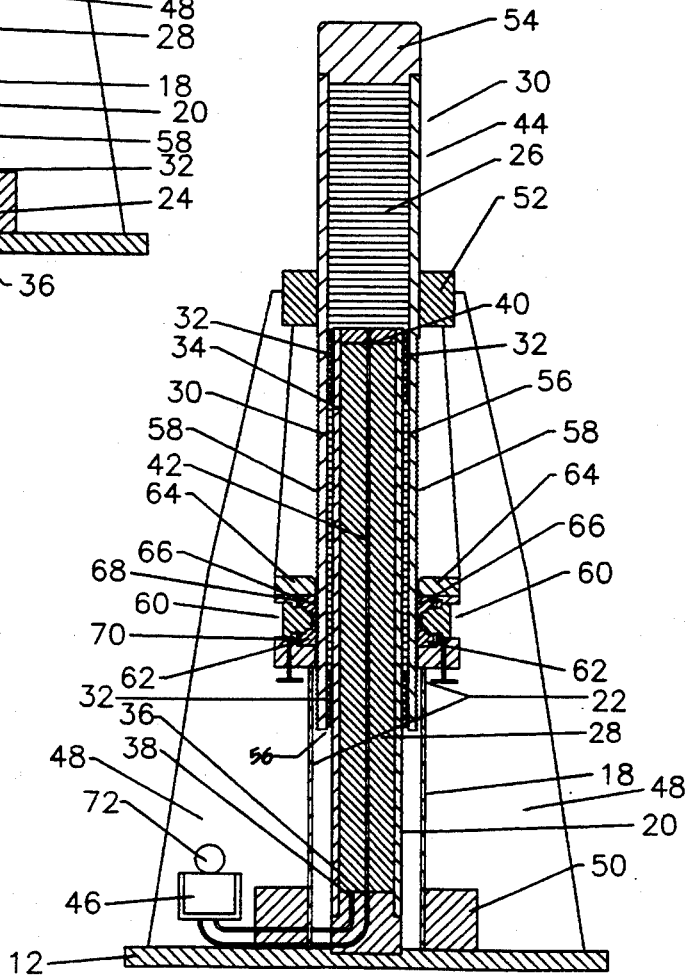
FIG. 5 is a cross-sectioned side view of a preferred embodiment of a lifting device in accordance with the present invention showing the cylindrical housing, piston assembly, lift cylinder and locking mechanism with the lifting device extended.
Figure 6:
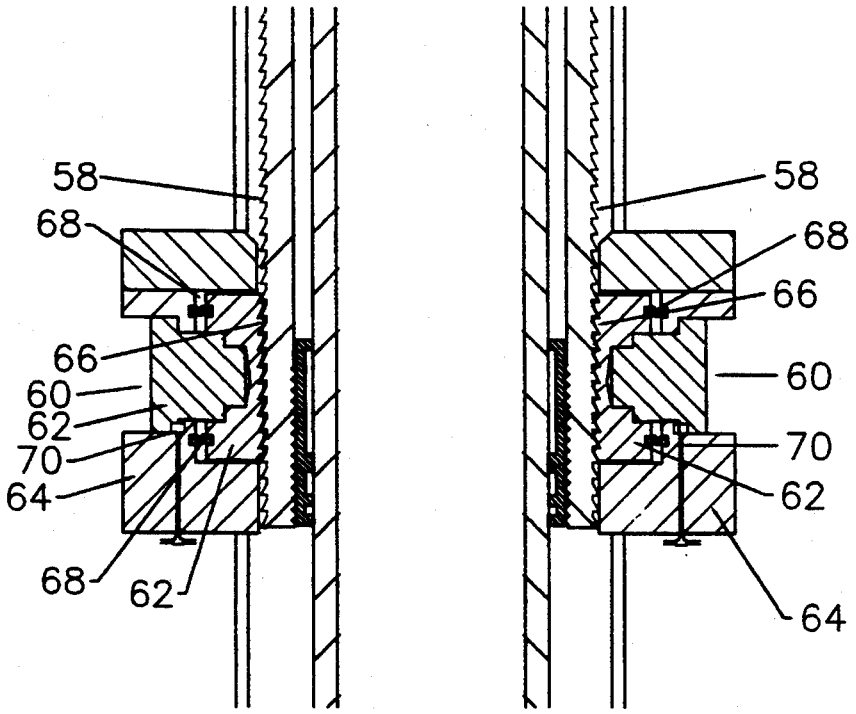
FIG. 6 is a cross-sectioned side view of a preferred embodiment of a lifting device in accordance with the present invention showing the locking mechanism.
Figure 7:
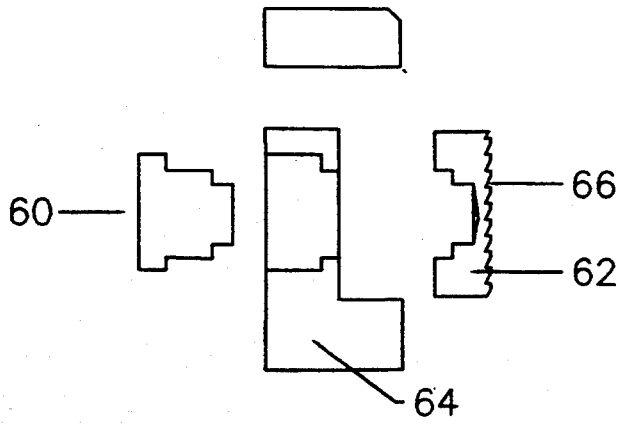
FIG. 7 is a cross-sectioned view of a preferred embodiment of a lifting device in accordance with the present invention showing the disassembled locking mechanism.

FIGS. 4 and 5 show a generally tubular shaped cylindrical housing 18 mounted in the center of the square base plate 12 perpendicular to the upper plane surface of the square base plate 12. The cylindrical housing 18 has a sealed tube 20 within an unsealed tube 22 with a space 24 between tubes 20 and 22, a fluid holding chamber 28, a fluid filled space 30, a plurality of hydraulic seals 32, an orifice 34 between the fluid filled space 30 and the fluid holding chamber 28, a plurality of orifices 36,38 in the bottom aspect of the fluid holding chamber 28 between the fluid holding chamber 28 and a plurality of external connections, an orifice 40 in the top aspect of the fluid holding chamber 28 between the fluid holding chamber 28 and the operating chamber 26, a tube 42 in the fluid holding chamber 28 for transferring pressurized hydraulic fluid to the operating chamber 26 which tube 42 attaches to bottom orifice 36 and top orifice 40, and a piston assembly 44 having an operating chamber 26.

The lifting device 10 has a plurality of gussets 48, with each gusset being generally triangular in shape with two flat plane sides, two relatively long edges and one relatively short edge. The lifting device 10 has a reservoir chamber 46. Hydraulic fluid is included in the reservoir chamber 46. Orifices 36 and 38 are attached to the reservoir chamber 46 by a plurality of tube means. The lifting device 10 has pressure relief means by which hydraulic fluid can escape the operating chamber 26 back to the reservoir chamber 46 to prevent overpressurization of the operating chamber 26 and resultant damage to the lifting device 10 and its components.

Each of the plurality of gussets 48 attach perpendicular to the upper plane surface of the square base plate 12. The relatively short base edge of each of the plurality of gussets 48 attaches and extends inwardly in generally upright triangular configuration from each of the four square corners of the square base plate 12 respectively, converging toward the center of the square base plate 12 to allow the plurality of gussets 48 to attach to and securely position the cylindrical housing 18 perpendicular to the square base plate 12 in the center of the square base plate 12. A support tube 50 is attached to the square base plate 12 and surrounds and attaches to the lower portion of the cylindrical housing 18 where the cylindrical housing 18 attaches to the square base plate 12.

The piston assembly 44 is attached in longitudinally slidable manner to the upper end of the cylindrical housing 18. A support collar 52 attaches to and supports the upper end of the cylindrical housing 18. The support collar 52 is attached to and secured in place by the plurality of gussets 48. The piston assembly 44 has an upper end 54, which upper end 54 is external to the upper portion of the cylindrical housing 18. The piston assembly 44 has a lower tubelike periphery 56 which slides in the cylindrical housing 18 in a longitudinally slidable manner within the space 24 between tubes 20 and 22 of the cylindrical housing 18. Longitudinal sliding of the piston assembly 44 in the cylindrical housing 18 increases or reduces the length of the lifting device 10. The piston assembly 44 is activated by means of forcing hydraulic fluid into the operating chamber 26 from the reservoir chamber 46 or discharging hydraulic fluid from the operating chamber 26 into the reservoir chamber 46 via tube 42 and orifices 36 and 40.

The lifting device 10 includes means for adjusting the pressure of the hydraulic fluid in the reservoir chamber 46 to activate the piston assembly 44. Increasing the pressure of the hydraulic fluid in the reservoir chamber 46 forces the hydraulic fluid through orifice 36, tube 42, orifice 40, and into the operating chamber 26. In one embodiment, the means for adjusting the pressure of the hydraulic fluid in the reservoir chamber 46 includes an air pressure driven hydraulic pump 72. The air pressure driven hydraulic pump has a maximum of 50 c.f.m. at 90 p.s.i. which pressurizes the hydraulic fluid in the reservoir chamber 46 and activates the piston assembly 44. In another embodiment, the means for pressurizing the hydraulic fluid in the reservoir chamber 46 includes an electrical hydraulic pump.

The piston assembly 44 includes longitudinally spaced ratchet teeth 58 milled into the lower tubelike periphery 56. The longitudinally spaced ratchet teeth 58 face in a downward direction. In one embodiment, the longitudinally spaced ratchet teeth 58 provide for a one-half inch spaced bite between the adjacent teeth.

The plurality of hydraulic seals 32 are positioned between the lower tubelike periphery 56 of the piston assembly 44 and the sealed tube 20 to form a fluid filled space 30. The fluid filled space 30 is connected with the fluid holding chamber 28 by means of orifice 34, which orifice 34 regulates the fluid exchange between fluid filled space 30 and fluid holding chamber 28.

Referring to FIGS. 4, 5, 6 and 7 the lifting device 10 has a locking mechanism 60. The locking mechanism 60 circumscribes, engages and secures the lower tubelike periphery 56 of the piston assembly 44. The locking mechanism 60 is affixed to the plurality of gussets 48. The locking mechanism 60 includes a plurality of jaws 62 movably affixed respectively on a plurality of mounts 64 on the plurality of gussets 48 which plurality of jaws 62 circumscribe, engage and secure the lower tubelike periphery 56 of the piston assembly 44. The plurality of jaws 62 have a plurality of ratchet teeth 66 on each jaw 62. The ratchet teeth 66 on each jaw 62 are arranged in opposition to the longitudinally spaced ratchet teeth 58 on the lower tubelike periphery 56 of the piston assembly 44. The ratchet teeth 66 on each jaw 62 engage in locking manner with the longitudinally spaced ratchet teeth 58 on the lower tubelike periphery 56 of the piston assembly 44. The longitudinally spaced ratchet teeth 58 on the lower tubelike periphery 56 of the piston assembly 44 and the ratchet teeth 66 on the plurality of jaws 62 are never out of alignment such as can occur with inadvertent rotation of the piston assembly 44 under load. In one embodiment, the ratchet teeth 66 on each of the plurality of jaws 62 provide for a one-half inch spaced bite between the adjacent teeth.

The lifting device 10 has a means of engaging the locking mechanism 60. The means of engaging the locking mechanism 60 includes a plurality of compressed springs 68 respectively mounted between each of the plurality of jaws 62 and each of the plurality of mounts 64 on the plurality of gussets 48. The plurality of compressed springs 68 force the plurality of jaws 62 away from the plurality of mounts 64 on the plurality of gussets 48 and against the lower tubelike periphery 56 of the piston assembly 44 engaging the ratchet teeth 66 on each jaw 62 in locking manner with the longitudinally spaced ratchet teeth 58 on the lower tubelike periphery 56 of the piston assembly 44.

The lifting device 10 has a means of disengaging the locking mechanism 60. The means of disengaging the locking mechanism 60 includes a plurality of air pressure pistons 70 mounted between the plurality of jaws 62 and the plurality of mounts 64 respectively on the plurality of gussets 48. Mounted respectively between each jaw 62 and each mount 64 on each gusset 48 is an air pressure piston 70. When the locking mechanism 60 is to be disengaged, air pressure is applied to the plurality of air pressure pistons 70 which activates the plurality of air pistons 70, compresses the plurality of compressed springs 68, forces the plurality of jaws 62 away from the lower tubelike periphery 56 of the piston assembly 44, and disengages the ratchet teeth 66 on each jaw 62 from the longitudinally spaced ratchet teeth 58 on the lower tubelike periphery 56 of the piston assembly 44. Simultaneously with air pressure being applied to the plurality of air pressure pistons 70, the piston assembly 44 is activated by discharging hydraulic fluid from the operating chamber 26 into the reservoir chamber 46. The discharge of hydraulic fluid pressure from the operating chamber 26 retracts the piston assembly 44 and causes hydraulic fluid pressure to decrease in the fluid filled space 30. Equalization of the hydraulic fluid pressure between the fluid filled space 30 and the fluid holding chamber 28 is accomplished and regulated by orifice 34. Orifice 34 serves to buffer against rapid retraction of the piston assembly 44.

The lifting device 10 is operated by a control means. The control means includes a means for adjusting the pressure of the hydraulic fluid in the reservoir chamber 46 to activate the piston assembly 44 by admitting hydraulic fluid into or discharging hydraulic fluid from the operating chamber 26. The control means includes a means of providing air pressure regulation for activating the air pressure pistons 70 and hydraulic fluid pressure in the operating chamber 26 when hydraulic fluid is to be discharged from the operating chamber 26. In one embodiment, the control means is remote from the lifting device 10 to provide for operational safety.

While a particular embodiment of the invention has been shown and described, it will be understood that the invention is not limited thereto, since modifications may be made that will become apparent to those skilled in the art.

What is claimed is:

1. A lifting device comprising:

a square base plate having an upper plane surface, a lower plane surface, and four edges;

a plurality of wheels attached to the square base plate in triangular arrangement whereby two of the wheels are attached in spaced relation perpendicular to an edge of the square base plate and a third steerable wheel is attached in movable manner to the center of the edge of the square base plate opposite the edge of the square base plate where the two wheels are attached, the plurality of wheels being attached to the square base plate so as to provide for a low center of gravity of the lifting device;

a handle attached to the third steerable wheel for directional movement and physical placement of the lifting device;

a generally tubular shaped cylindrical housing mounted in the center of the square base plate perpendicular to the upper plane surface of the square base plate;

the cylindrical housing having a sealed tube within an unsealed tube and a space between the sealed tube and the unsealed tube;

the cylindrical housing having a fluid holding chamber interconnected with a fluid filled space by means of an orifice therebetween;

the cylindrical housing having an orifice between and interconnecting the fluid filled space and the fluid holding chamber;

the cylindrical housing having a fluid filled space interconnected with the fluid holding chamber by means of the orifice therebetween, which fluid filled space and fluid holding chamber interconnection equalizes the hydraulic fluid pressure therebetween and buffers against rapid retraction of a piston assembly;

the cylindrical housing having a plurality of hydraulic seals positioned between a lower tubelike periphery of a piston assembly and the sealed tube to form the fluid filled space;

the cylindrical housing having a plurality of orifices in a bottom aspect of the fluid holding chamber between the fluid holding chamber and a plurality of external connections which plurality of orifices are attached to a reservoir chamber by a plurality of tube means;

the cylindrical housing having an orifice in a top aspect of the fluid holding chamber between the fluid holding chamber and an operating chamber;

the cylindrical housing having a tube in the fluid holding chamber for transferring pressurized hydraulic fluid to the operating chamber, which tube attaches to an orifice in the bottom aspect of the fluid holding chamber and the orifice in the top aspect of the fluid holding chamber;

a piston assembly having an operating chamber, which piston assembly is attached in longitudinally slidable manner to an upper portion of the cylindrical housing;

the piston assembly having a lower tubelike periphery which slides in the cylindrical housing in a longitudinally slidable manner within the space between the sealed tube and the unsealed tube;

a plurality of gussets, with each gusset being generally triangular in shape with two flat plane sides, two relatively long edges, and one short edge, with each of the plurality of gussets attaching perpendicularly to the upper plane surface of the square base plate with the short edge of each gusset attaching and extending inwardly from one of a plurality of square corners of the Square base plate and all of the plurality of gussets converging toward the center of the square base plate, allowing the plurality of gussets to attach to and securely position the cylindrical housing perpendicular to the square base plate in the center of the square base plate;

a reservoir chamber including hydraulic fluid;

a plurality of tube means attaching the reservoir chamber to the plurality of orifices in the bottom aspect of the fluid holding chamber;

a pressure relief means by which hydraulic fluid can escape the operating chamber to prevent overpressurization of the operating chamber;

a support tube attaching to the square base plate which surrounds the lower portion of the cylindrical housing where the cylindrical housing attaches to the square base plate;

a means for adjusting the pressure of hydraulic fluid in the reservoir chamber;

a locking mechanism which circumscribes, engages and secures the piston assembly;

a means of engaging the locking mechanism;

a means of disengaging the locking mechanism; and, a control means for operating the lifting device.

2. A lifting device according to claim 1 wherein the piston assembly includes longitudinally spaced ratchet teeth on the lower tubelike periphery.

3. A lifting device according to claim 2 wherein the locking mechanism includes a plurality of jaws movably affixed on a plurality of mounts on the plurality of gussets, which plurality of jaws circumscribe, engage and secure the lower tubelike periphery of the piston assembly.

4. A lifting device according to claim 3 wherein the plurality of jaws include a plurality of ratchet teeth on each jaw, which ratchet teeth are arranged in opposition to and engage in locking manner with the longitudinally spaced ratchet teeth on the lower tubelike periphery of the piston assembly.

5. A lifting device according to claim 4 wherein the means of engaging the locking mechanism includes a plurality of compressed springs respectively mounted between each of the plurality of jaws and the plurality of mounts on the plurality of gussets, which plurality of compressed springs force the plurality of jaws against the lower tubelike periphery of the piston assembly.

6. A lifting device according to claim 5 wherein the means of disengaging the locking mechanism includes a plurality of air pressure pistons, which plurality of air pressure pistons force the plurality of jaws away from the lower tubelike periphery of the piston assembly.

7. A lifting device according to claim 6 wherein the means for pressurizing hydraulic fluid in the reservoir chamber includes an air pressure driven hydraulic pump.

8. A lifting device according to claim 6 wherein the means for pressurizing hydraulic fluid in the reservoir chamber includes an electrical hydraulic pump.

9. A lifting device according to claim 6 wherein the control means for operating the lifting device includes a remote control.

* * * * *